United States Patent [19]

Flum

[11] Patent Number: 4,750,623

[45] Date of Patent: Jun. 14, 1988

[54] STACKABLE SHELVING SYSTEM

[75] Inventor: Paul Flum, Ladue, Mo.

[73] Assignee: Paul Flum Ideas, Inc., St. Louis, Mo.

[21] Appl. No.: 25,102

[22] Filed: Mar. 12, 1987

Related U.S. Application Data

[62] Division of Ser. No. 559,968, Dec. 9, 1983, Pat. No. 4,653,651.

[51] Int. Cl.[4] ..... A47F 7/00

[52] U.S. Cl. ..... 211/59.4; 211/74; 211/150

[58] Field of Search ..... 211/59.4, 71, 72, 74, 211/188, 194, 150; 108/55.1, 55.3, 56.3, 53.1, 53.3

[56] References Cited

U.S. PATENT DOCUMENTS

| | | | |
|---|---|---|---|
| 2,928,551 | 3/1960 | Abrams et al. | 211/59.4 |
| 2,982,419 | 5/1961 | Shiels | 211/59.4 X |
| 2,992,742 | 7/1961 | Pendergrast | 211/150 X |
| 3,161,158 | 12/1964 | Lurey | 211/59.4 X |
| 3,527,360 | 9/1970 | Thielking | 211/150 |
| 3,631,820 | 1/1972 | Taber | 211/59.4 X |
| 3,688,914 | 9/1972 | Taber | 211/150 X |
| 4,653,651 | 3/1987 | Flum | 211/59.4 |

*Primary Examiner*—Robert W. Gibson, Jr.
*Assistant Examiner*—Blair Johnson
*Attorney, Agent, or Firm*—Haverstock, Garrett & Roberts

[57] ABSTRACT

A product display shelving system for holding product containers in a stackable arrangement thereon comprising a base structure, a pair of frame members extending upwardly from adjacent one end portion of the base structure, a base shelf member adaptable to be supported on the base structure and a plurality of additional shelf members each adaptable to rest upon and to be supported by the product containers positioned on a shelf member located immediately therebelow, the base shelf member and the additional shelf member each including a product supporting floor portion having a surface contour defining a plurality of adjacent product support areas thereover, each of the product support areas being adaptable for holding and supporting at least one product container positioned respectively thereon, each of the plurality of additional shelf members being hingedly attached to the upwardly extending frame members at spaced vertical locations therealong such that each is pivotally movable between a substantially horizontal product holding position and a retracted out-of-the-way storage position angularly related thereto, each such additional shelf member including surface portions located on the lower surface thereof for engaging and resting upon the product containers positioned immediately therebelow when each is moved and located in its substantially horizontal product holding position.

8 Claims, 14 Drawing Sheets

STACKABLE SHELVING SYSTEM

This application is a division, of application Ser. No. 559,968, filed 12/9/83, now U.S. Pat. No. 4,653,651, issued Mar. 31, 1987.

The present invention relates to product display devices for use in storing and merchandising shelved products and, more particularly, to various embodiments of a stackable shelving system adaptable for holding and merchandising a wide variety of bottled products and other product containers. Each shelving system includes a base shelf member adaptable to be supported on a floor or other support structure having means associated therewith for holding and retaining a plurality of product containers positioned thereon; a plurality of additional shelf members each adaptable to rest upon and to be supported by the products or product containers positioned on the shelf member located therebelow; and an optional holding or storage member adaptable for retaining and storing any desired number of the plurality of additional shelf members when said shelf members are not in use. Each of the stackable shelf members also includes means on the bottom portion thereof for receiving and engaging the upper portion of the product containers upon which it is supported such as the cap or crown portion associated with bottled products. Each embodiment of the present system is specifically designed to accommodate a particular product container size and shape including multi-pack arrangements and, although the present devices are ideally suited for holding and merchandising both single bottled and multi-pack bottled soft drink products, they are likewise adaptable for use in a multiplicity of other product display applications.

Numerous display systems and other devices including modular display fixtures have been designed and manufactured for use in merchandising bottled products such as soft drink products to customers. These display devices are commonly employed by supermarkets, convenience stores, grocery outlets, drug and liquor stores, fast food outlets, and a wide variety of other wholesale and retail stores for use in store display windows and other display areas to show and focus attention on the wares displayed therein. One of the major problems associated with storing and displaying bottled goods for sale to customers and, in particular, bottled soft drink products of the type that contain sixteen ounces, one-half liter, or two liters or more of liquid, is the inefficient use of available shelf space, the relative unstableness achieved by stacking such products one upon the other on conventional store shelving, and the inability of the merchant to constantly provide an attractive and orderly arrangement of such products which are readily visible and easily accessible to the customer. Typically, such products, especially numerous bottled soft drink products which are packaged in a wide variety of container sizes and shapes including multi-pack arrangements, are randomly distributed and sometimes stacked in segregated areas on a shelf or other display device or in the aisle or other floor area in such a manner that the selection of a particular product, access to that product, and the removability of that product from the shelf or other display device by the customer becomes, at times, difficult if not impossible. In addition, the storing and displaying of bottled products on conventional store shelving takes up a considerable amount of shelf space; it does not maximize usage of the vertical space available between adjacent shelves; and it often requires the installation of additional shelving or other means to accommodate such products. This is especially undesirable in small convenience stores and other wholesale or retail outlets where available shelf space is extremely limited.

Although various product shelving displays have been designed to alleviate some of the aforementioned problems, all such devices still suffer from certain disadvantages and shortcomings including being relatively large, bulky, awkward, expensive, and difficult, if not impossible, to use on or in conjunction with conventional shelving and other display devices and arrangements presently available in supermarkets and other merchandising outlets. In addition, none of the known devices for storing and merchandising products, particularly bottled products, are as simple structurally as the present contructions and none utilize as efficient and effective means for storing and attractively displaying such products to consumers and for safely holding such products in a relatively rigid, stabilized stackable arrangement. Additionally, the present devices can be conveniently positioned and arranged on any available floor space and they provide for easy selection, accessibility, and removability of a particular goods item by the customer.

The various embodiments of the present display system overcome many of the disadvantages and shortcomings associated with the known display devices, and teach the construction and operation of a relatively simple stackable shelving system adaptable for holding and merchandising therefrom both single bottled and multi-pack bottled soft drink products as well as a wide variety of other bottled and packaged goods. Each of the present display systems includes a base shelf member adaptable to be supported on a floor or other support structure for holding and merchandising products positioned thereon; a plurality of substantially similar shelf members each adaptable to rest upon and to be supported by the products positioned in a particular controlled way on the shelf member located immediately therebelow; and a holding or storage member positioned adjacent the base shelf member for retaining and storing a plurality of shelf members when said shelf members are not in use. More specifically, each base shelf member is preferably of a one-piece plastic molded construction and each includes opposed front and rear edges, opposed side edges, and a floor portion extending substantially the full length and width therebetween. The floor portion associated with each base shelf member is specifically constructed to accommodate and support a particular bottled product or group of products positioned thereon depending upon the particular size and shape of the product container to be displayed therein or the particular packaging arrangement associated therewith. For example, the floor portion of the base shelf member associated with one embodiment of the present display system includes means on the upper surface thereof in the form of a plurality of upstanding wall portions, said upstanding wall portions defining a plurality of adjacent areas arranged in a grid-like manner, each adjacent area being adaptable for holding and retaining a conventional multi-pack arrangement of bottled soft drink products. Alternative embodiments include base member floor portions having a plurality of specifically shaped cavities formed and distributed uniformly over the entire extent thereof for holding and retaining bottled soft drink products of the type that are packaged in containers having varying bottom wall configurations. Additionally, the bottom portion of the base shelf member is likewise designed such that at least a portion thereof lies flush with the floor or other supporting structure upon which it is positioned. This helps to stabilize and improve the structural integrity of the entire shelving system especially when a large number of the present shelf members are used to stack numerous layers of products one above and upon the other.

Each of the present shelving systems also includes a plurality of substantially similar shelf members preferably of a one-piece plastic molded construction likewise having opposed front and rear edges, opposed side edges, and a floor portion extending substantially the full length and width therebetween. Like the base shelf member, the floor portion associated with each of the additional shelf members has its upper surface adapted to hold and retain the same type and arrangement of products as the base shelf member when such products are positioned thereon. In addition, the opposite or lower surface of each of said floor portions includes means thereon adaptable for cooperatively engaging the upper portions of the products or product containers therebelow such as the cap or crown portion associated with bottled products or any other closure means associated therewith and this is done to provide structural integrity between the adjacent layers of bottled products being supported. This means that once a merchant fully stocks the base shelf member with a bottled product, he simply positions one of the additional shelf members on top of the previously loaded layer of products and, if necessary, makes sure that the shelf member is properly aligned on the next lower layer of products and thereafter stocks that particular shelf member. Each additional shelf member, when engaged with the products positioned therebelow, is supported by and stackably held on said layer of products immediately therebelow and this process may be repeated until any desired display height is achieved. This ability to stack each of the present shelf members directly upon the products positioned therebelow allows a user to maximize the available merchandising space, and since the present devices can be conveniently positioned and arranged on any available floor space, they provide the user with greater flexibility in changing and relocating product displays while at the same time always providing a neat, orderly, safe and attractive arrangement of such products. The present device enables displaying the maximum number of products in a given merchandising space. Besides being supported on the floor, the present devices may likewise be positioned and arranged on other support structures including being utilized in conjunction with a variety of existing shelf space presently available in supermarkets, convenience stores, and a wide variety of other merchandising stores.

Each of the present shelving systems may also include a holding or storage member positionable adjacent the base shelf member for holding and storing the plurality of shelf members associated with each of the various embodiments of the present display system. Once all of the products are removed from a particular shelf member, that particular shelf member may be removed from the products positioned therebelow and placed in the storage member in stored position for future use. In this regard, the present shelf members are also stackable and nestable one on top of the other for ease of storage in minimum space in the holding member, and for ease of packaging and transportation. Like all of the shelf members comprising the present display systems, the storage member is likewise preferably of a one-piece plastic molded construction and may also include means for cooperatively engaging the base member when positioned adjacent thereto to limit and/or prevent movement thereof. Although use of the holding or storage member is not essential to the operation and use of the present invention, it does provide for an orderly and attractive arrangement of the shelf members when they are not being utilized.

It is important to note that the floor portions associated with the shelving members comprising each of the various embodiments of the present display system are specifically constructed to accommodate and support a particular type of packaged bottled product. It is also recognized that the present shelf members can be designed to accommodate almost any type of product or product container including products other than bottled products. In addition, another embodiment of the present shelving system utilizes a display stand arrangement having means associated therewith wherein each respective shelf member is normally biased to an out-of-the-way retracted position such that when all of the products positioned on any one shelf are removed therefrom, that particular shelf member will automatically flip upwardly to a retracted storage position thereby exposing the products positioned on the shelf member located immediately therebelow for easy and safe customer selection and removal. Other display stand applications are also disclosed. Although it is anticipated that the various embodiments of the present shelving system will be utilized primarily for displaying and merchandising single bottled and multi-pack bottled soft drink products, the present devices are likewise adaptable for use with other bottled goods and in other merchandising applications.

It is therefore a principle object of the present invention to provide an efficient and attractive shelving system adaptable for storing and merchandising a wide variety of shelved products.

Another object is to provide a product merchandising system that is structurally and operationally relatively simple and inexpensive to make and install.

Another object is to provide a stackable shelving system which more effectively utilizes available merchandising areas and maximizes usage of the vertical space between shelved products.

Another object is to provide a stackable shelving system which organizes the products positioned thereon for attractive display and for easy access and removal.

Another object is to provide an improved product display system adaptable for storing and displaying bottled goods such as single bottled and multi-pack bottled soft drink products of the type that contain sixteen ounces, one-half liter or two liters or more of liquid.

Another object is to provide maximum use of space available for displaying merchandise.

Another object is to teach the construction of a product merchandising system which can be easily and quickly refilled from any side.

Another object is to provide a stackable shelving system that is relatively easy to clean, maintain, install and replace.

Another object is to provide a stackable shelving system adaptable to be supported on any available floor space or other support structure for holding and merchandising products therefrom.

Another object is to provide a stackable shelving system which organizes the products positioned thereon in an orderly, attractive and stable display for safe and easy access by the customer.

Another object is to teach the construction of a stackable shelving unit wherein the individual shelf members are normally biased to an out-of-the-way retracted position such that when all of the products positioned on a particular shelf member are removed therefrom, that shelf member will automatically move to a retracted storage position thereby exposing the products positioned therebelow.

Another object is to provide an attractive shelving system which exposes a greater portion of the products being displayed to customer view.

Another object is to provide a stackable shelving system wherein tne individual shelf members are nestable one within another to occupy minimum space and for ease of storage, packaging and transportation.

Another object is to provide a shelving display construction which is lightweight, durable, easy to assemble, and able to withstand moderate impact and mishandling without breakage.

Another object is to provide a shelving system which enables hard to stack products to be easily and safely stacked in a stable and attractive display arrangement.

These and other objects and advantages of the present invention will become apparent to those skilled in the art after considering the following detailed specification which discloses several representative embodiments of the present shelving system in conjunction with the accompanying drawings, wherein.

Figure 1:
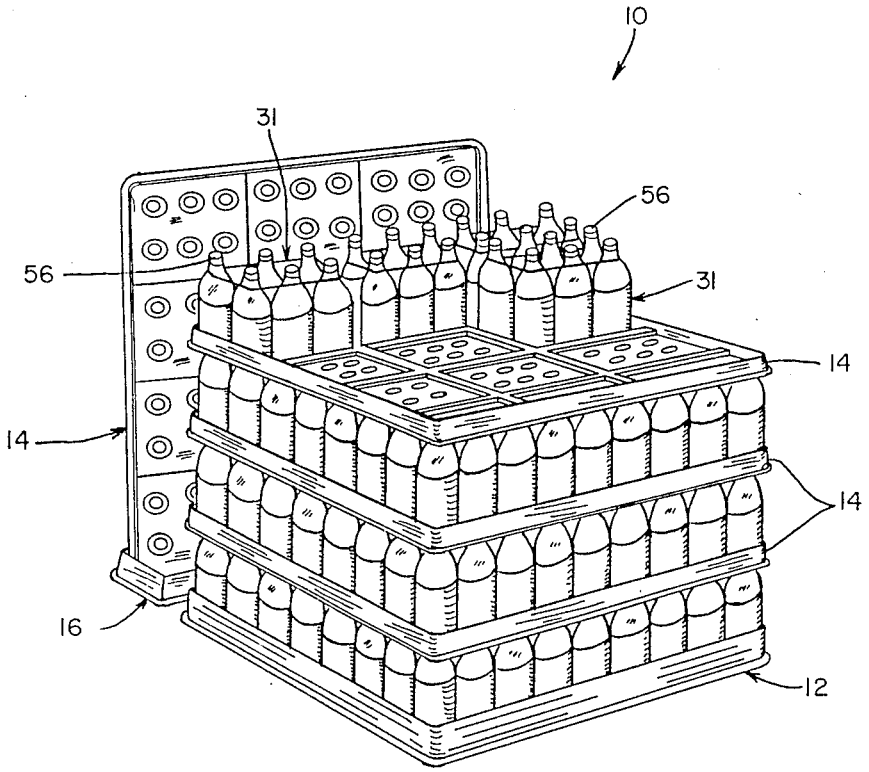
FIG. 1 is a perspective view showing one embodiment of a stackable shelving system constructed according to the teachings of the present invention.

Referring to the drawings more particularly by reference numbers, wherein like numerals refer to like parts, number 10 in FIG. 1 identifies one embodiment of a product merchandising display system constructed according to the teachings of the present invention. The shelving display system 10 is specifically designed for storing and merchandising bottled products such as multi-pack bottled soft drink products of the type wherein each bottle contains 16 ounces or a half liter or more of liquid. The present system includes a base shelf member 12, a plurality of similar shelf members 14 spaced thereabove, and a holding or storage member 16 adaptable for the orderly holding and retaining of a plurality of the shelf members 14 when said members are not being utilized in the display system 10.

Figure 2:
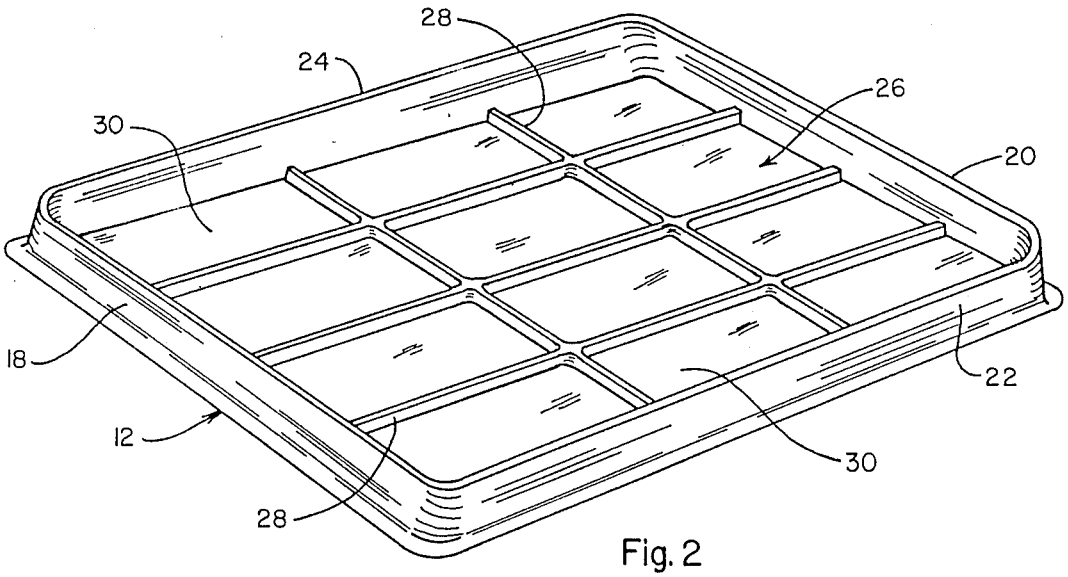
FIG. 2 is a top perspective view of the base shelf member of the shelving system shown in FIG. 1.
Figure 3:
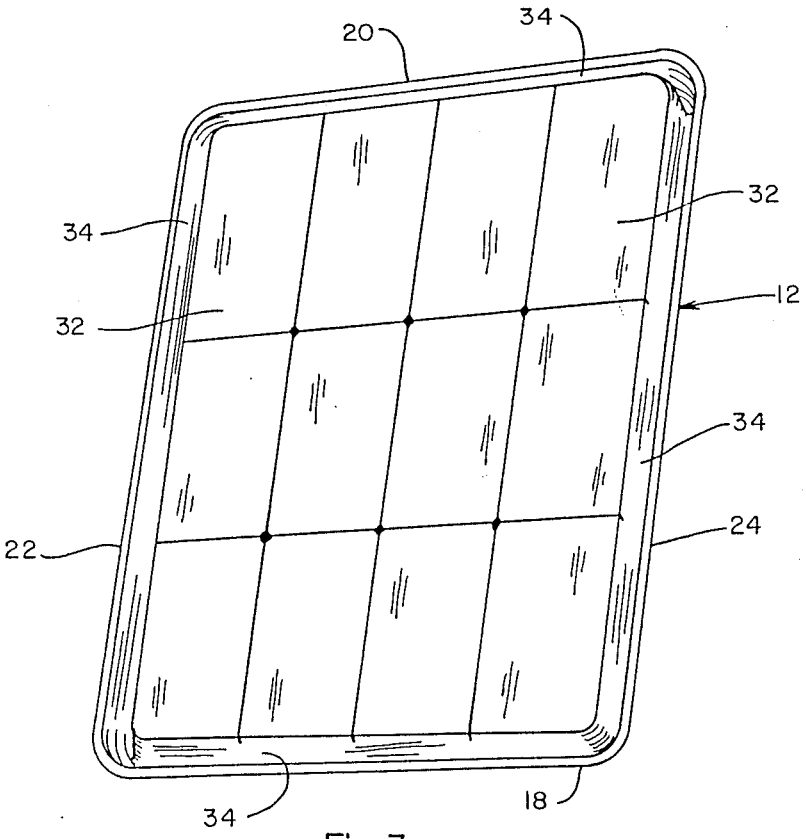
FIG. 3 is a bottom perspective view of the base shelf member of FIG. 2.

The base member 12 is a generally one-piece rectangular structure preferably formed of a plastic molded construction and includes spaced front and rear walls 18 and 20, spaced side walls 22 and 24, and a floor portion 26 which extends substantially the full length and width of the member 12 between the front, rear, and side walls as best shown in FIGS. 2 and 3. The walls 18, 20, 22 and 24 support the floor 26 in a substantially horizontal planar position such that when tne base member 12 is resting on a store floor other substantially horizontal supporting surface, products placed thereon will be arranged in a substantially level horizontal position, a feature which is especially important when such products are going to be stacked one upon the other as will be explained. In addition, since the base shelf member 12 is specifically designed to be positioned and supported on any available store floor space, the front, rear and side walls 18, 20, 22 and 24 respectively are slightly higher than the shelf walls 36, 38, 40 and 42 associated with the members 14 (FIG. 4) to protect the products positioned thereon from damage due to floor cleaning apparatus and from inadvertent kicking by customers.

The base member 12 also includes a plurality of spaced upstanding wall portions or partitions 28 that extend substantially along tne full length and width of the floor 26 as shown in FIG. 2. The partitions 28 are arranged in a grid-like manner between the front, rear and side walls 18–24 and define therebetween a plurality of adjacent areas 30 adaptable for supporting products positioned respectively thereon. The partitions 28 are specifically arranged and dimensioned such that each product support area 30 is adaptable for holding and retaining multi-pack arrangements of bottled soft drink products such as the six-pack container arrangements 31 shown in FIG. 1. Once a multi-pack of bottled products is positioned within each of the product support areas 30, each multi-pack will be surrounded by the partitions 28, which partitions 28 serve to accurately position and hold and retain the products within the respective spaces 30 and prevent them from shifting. It is preferred that the wall portions or dividers 28 be integrally formed with the base structure 12 to simplify the construction and to lend strength and stability to the shelf member 12, although in some cases it may be more desirable to attach the partitions 28 as separate members. It is also recognized that the spacing of the dividers 28 is such as to accommodate individual containers or multi-container packs as desired.

FIG. 3 illustrates the bottom of the base shelf member 12 whicn is formed by a plurality of floor engaging portions 32 which are all in the same plane. This stabilizes the device and increases the load carrying capacity. This also helps to stabilize and rigidify the entire shelving system 10 especially when a plurality of the shelf members 14 are utilized to stack vertical layers of products one upon the other as will be explained. A groove or channel 34 also extends upwardly circumferentially around all four sides of the bottom floor portions 32 as shown in FIG. 3 and is formed between the corresponding wall portions 18, 20, 22 and 24 and the respective side edges of the floor portions 32 positioned adjacent thereto. The groove 34 is shaped and dimensioned to receive cooperatively engageable means located on the holding or storage member 16 for restricting the movement thereof as will be hereinafter explained.

Figure 4:
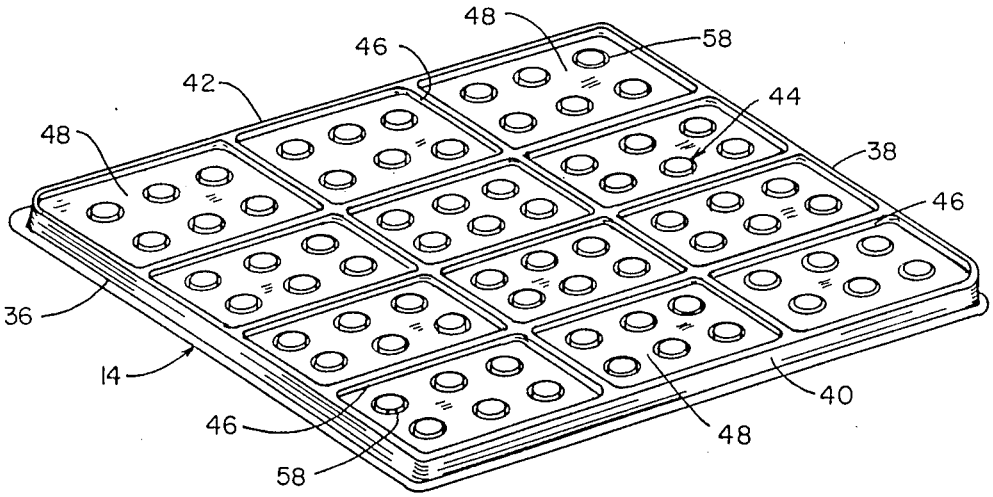
FIG. 4 is a perspective view of one of the other shelf members associated with the shelving system of FIG. 1.

The shelf members 14 are also preferably of a one-piece plastic molded construction and likewise include opposed front and rear walls 36 and 38, opposed side walls 40 and 42, and a floor wall portion 44 which extends substantially the full length and width of the member 14 between the front, rear and side walls as shown in FIG. 4. Like the floor 26, the floor 44 has a plurality of upstanding wall portions or partitions 46 extending substantially across the upper surface thereof in a grid-like manner defining a plurality of adjacent product support areas 48. The partitions 46 and the product support areas 48 are arranged and dimensioned substantially similar to the partitions 28 and the product support areas 30 associated with the base member 12 and each of the areas 48 are similarly adaptable for holding and retaining the same types of multi-pack bottled products.

Each shelf member 14 is specifically designed to be supported on the products positioned on the shelf member located immediately therebelow and, to this end, the bottom surface of each shelf member 14 differs from the bottom surface of the base member 12. In this regard, the bottom surface 50 of the floor 44 includes means shown in the form of a plurality of circular projections 52, each projection 52 forming a cavity or depression 54 adaptable respectively for receiving and accommodating the cap or bottle crown portion such as the bottle portion 56 (FIG. 1) or any other closure means associated with each respective bottled product positioned on the shelf therebelow. The circular projections 52 are spaced and arranged on the bottom surface 50 such that when the shelf member 14 is positioned on top of the group or layer of products previously loaded on the shelf therebelow, each of the projections 52 are in alignment with the respective cap or crown portions 56. The projections 52 enable the shelf members 14 to be placed directly upon the products positioned therebelow and, when engaged with the cap or bottle crown portions 56, locate and hold the shelves 14 in relatively stable, stationary positions thereby preventing said shelf member from moving or shifting. This means that once a merchant fully loads the base member 12 with a particular multi-pack bottled product, he or she can continue to stack the same or similar types of products layer upon layer by simply positioning one of the shelf members 14 on top of each layer until a desired display height is achieved. This ability to stack each of the shelf members 14 directly upon the bottled products positioned immediately therebelow allows a merchant to more effectively utilize available merchandising space and it maximizes use of the vertical space between shelved products. This is not true of conventional store shelving wherein the inefficient use on such shelf space almost always occurs due to both the load carrying limitations associated with the shelving utilized and the size and shape of the bottled products positioned thereon. In addition, stacking of bottled products on conventional store shelving is difficult and time comsuming and results in unused vertical space between the various shelves and the stacked products are likewise relatively susceptible to overturning and even rolling off the shelf. The present shelving system overcomes these disadvantages and allows a merchant to stack and display a maximum amount of products in a relatively limited space. The present system also lends itself to prestacking products as at the factory or off the store floor as will be explained.

Figure 5:
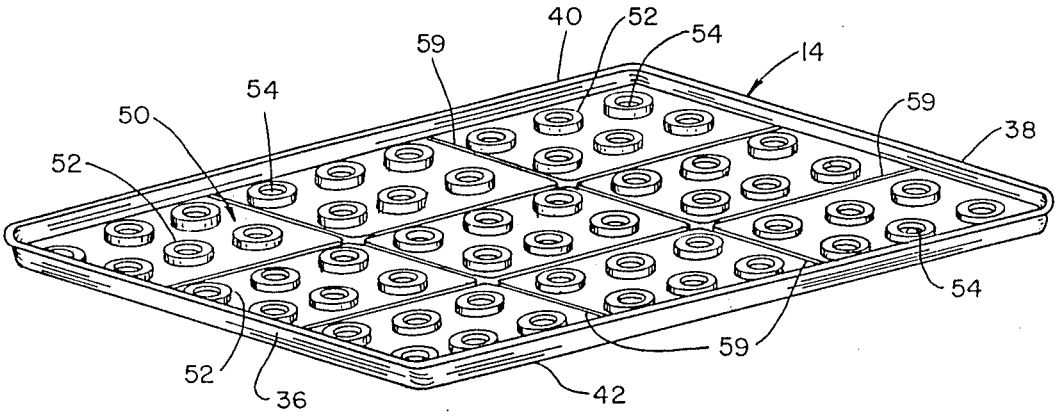
FIG. 5 is a perspective view of the bottom of the shelf member of FIG. 4 detailing the structure of the lower surface thereof which cooperates with the cap portions of the respective bottled products positioned therebelow.

The shelf members 14 also differ from the base member 12 in that the bottom surface 50 of the floor surfaces 44 are not necessarily flush with the bottom peripheral edge of the walls 36, 38, 40 and 42. Instead, it is usually advantageous to locate the bottom surface 50 intermediate the top and bottom edge of the side walls 36–42 such that the projections 52 do not extend or protrude beyond the peripheral edge although the plane of the bottom surface 50 can be varied as desired to expose more or less of the upper portion of the products displayed in the shelf member therebelow. In addition, although the projections 52 are shown as being circular in shape to mate with a wide variety of the more common closure caps used on bottled soft drink and other types of bottled products, it is recognized that the projections 52 may be fashioned into a variety of other shapes and configurations without departing from the teachings and practice of the present invention. The important thing is that the contour of the projections 52 be adaptable to engage the upper portion of the particular products or product containers to be displayed. It is also important that each portion of each opposite product support area 48 include a number of projections 52 corresponding to the number of products contained in the multi-pack arrangement positioned on each product support area 48. The shelf member 14 shown in FIGS. 4 and 5 illustrates a shelf member adaptable for holding a plurality of six-pack containers but it is recognized that the overall dimensions of each shelf member 14 and the product support areas 48 associated therewith are subject to variations in size, shape and number of projections 52 depending on the products to be displayed.

Figure 6:
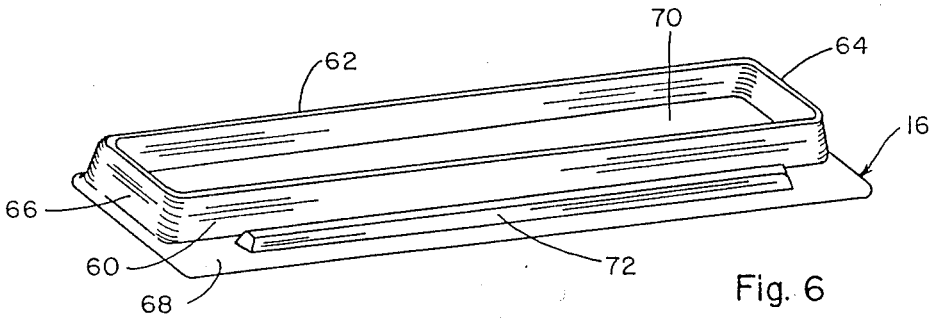
FIG. 6 is a perspective view of the shelf storage member associated with the shelving system of FIG. 1.

The shelving system 10 may also include a holding or storage member 16 for holding the shelves 14 when they are not in use as shown in FIGS. 1 and 6. The storage member 16 is substantially rectangular in shape and includes opposed side walls 60 and 62, opposed end walls 64 and 66, and a floor portion 68. The walls 60–66 in conjunction with a portion of the floor 68 define a cavity 70 adaptable for holding and storing a plurality of tne shelf members 14 when placed thereon in an upright nestable position. The walls 60–66 are shown of the same height as the side walls 18–24 of the base member 12 and are dimensioned to receive at least one side of the respective shelf members 14 when placed within the cavity 70. In a typical display arrangement as shown in FIG. 1, the holding member 16 may be positioned adjacent the base shelf member 12 or adjacent a store wall or other upright supporting member. This allows a merchant to easily and conveniently store any number of shelf members 14 in close proximity to the product display arrangement 10 such that additional shelf members 14 may be conveniently added to the display 10 or, as products are removed from a particular shelf member 14, that particular shelf may be removed from the display 10 and placed in the holding member 16 for future use. To facilitate storage in the holding member 16 and for ease of packaging and transportation, the shelf members 14 are constructed and dimensioned so as to be stackable and nestable one within the other. To this end, the side walls 36, 38, 40 and 42 may be slightly at an angle other than normal to the floor to facilitate nesting of the members 14 and reduce the storage space required therefor.

The holding member 16 may also include an upwardly projecting flange 72 which is spaced from and extends at least partway along one of the side walls such as the side wall 60 shown in FIG. 6. The flange 72 is located, shaped and dimensioned such that when the holding member 16 is placed in an overlapping condition with the base shelf member 12, the flange 72 is insertably receivable into and cooperatively engageable with the groove or channel 34 formed adjacent the bottom surfaces 32 of the base member 12. When so positioned, the interlocking of the flange 72 with the groove 34 holds the member 16 in place adjacent the base member 12 thereby substantially restricting, if not totally preventing, relative movement therebetween. Since the groove or channel 34 extends circumferentially around the bottom floor portions 32, the flange 72 will cooperatively engage the groove 34 on any side thereof thereby allowing a user to position and locate the storage member 16 adjacent any side of the base member 12 as desired. This provides greater flexibility in using and orienting the present system 10 in any particular merchandising area. Like the members 12 and 14, the member 16 is preferably of a one-piece plastic molded construction and, although the member 16 is not essential to the operation and use of the members 12 and 14, when used it does provide for an orderly and attractive arrangement of the shelf members 14 when the members 14 are not in use.

In addition to displaying products in an orderly, attractive, stackable yet readily accessible manner, the present display system 10 effectively utilizes the available merchandising space and also allows the merchant to easily fill and refill the device from the front, rear or either side thereof. This ability to load the device from any side is an advantage because it enables more versatile placement and orientation of the device in a merchandising area. Since each shelf member 12 and 14 is open on all four sides thereof, access to the products positioned on the uppermost shelf is unrestricted, a feature not true of most known prior art devices. The present system 10 for stackably displaying products is particularly advantageous because it can be erected and oriented in any location; it can be easily and conveniently moved from one merchandising location to another; it maximizes use of available merchandising space including the vertical space between the various layers of products; and it provides a stable, attractive display arrangement of products which are easily accessible for customer selection and removal. A typical display arrangement generally includes one base shelf member 12, a plurality of shelf members 14 depending on product height, and one holding member 16.

Since many articles of merchandise and, in particular, bottled soft drink products, are packaged in containers having unique and unusual shapes including unusual shapes or contours for their bottom surfaces, it is particularly important that the present shelving system be made adaptable for use with the various sizes and shapes of packages and product containers associated with the goods items to be displayed therein. FIGS. 7–10 show various components of an alternative embodiment of the shelving system 10 wherein the shelf members 74 and 92 are specifically adaptable for use in storing and displaying bottled soft drink products of the type that contain two liters or more of liquid. More specifically, FIGS. 7 and 8 disclose a base shelf member 74 having opposed side walls 76 and 78, opposed end walls 80 and 82, and a floor portion 84 which extends substantially the full length and width of the member 74. The wall and floor arrangement of the base member 74 is similar in construction to the base shelf member 12 previously discussed. However, the member 74 differs from the member 12 in that the member 74 includes a plurality of rows and columns of individual product cavities 86 extending downwardly from the floor portion 84 to the supporting surface therebelow, each of the cavities 86 being adaptable for receiving, supporting and holding one bottled product positioned therewithin. The cavities 86 are shown as being substantially hemispherical in shape with a relatively flat bottom wall 88 and a rounded side wall 90. Each cavity 86 is adaptable for intimately engaging and holding a container having a bottom wall configuration that corresponds thereto such as two liter bottled products having either a base-cup shaped bottom or a petaloid shaped bottom portion. It is anticipated that the cavities 86 may be shaped and dimensioned to accommodate any particular size and shape package or product container and, to this extent, the particular shapes and number of the cavities 86 including the arrangement of the cavities 86 on the floor portion 84 can be varied considerably without departing from the teachings of the present invention.

Figure 8:
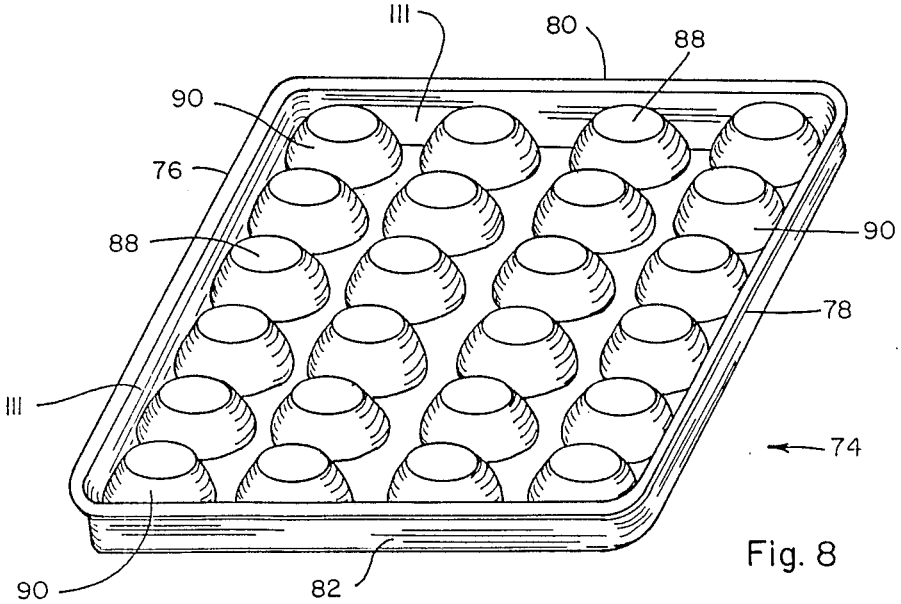

Referring to FIG. 8, it should be noted that the side walls 90 of the cavities 86 are dimensioned depthwise so as to align the bottom cavity walls 88 with the free edges of the shelf side walls 76, 78, 80 and 82 such that when the base member 74 is positioned on a supporting structure such as a store floor, the bottom wall 88 of each respective cavity 86 lies flush with the supporting structure for the same reasons as already explained with respect to the base shelf member 12. This means that the walls of the cavities 86 add substantially to the structural integrity of the member 74 and to its load carrying capacity. Like the base member 12, the member 74 is preferably of one-piece plastic molded construction to simplify its construction.

Figure 9:
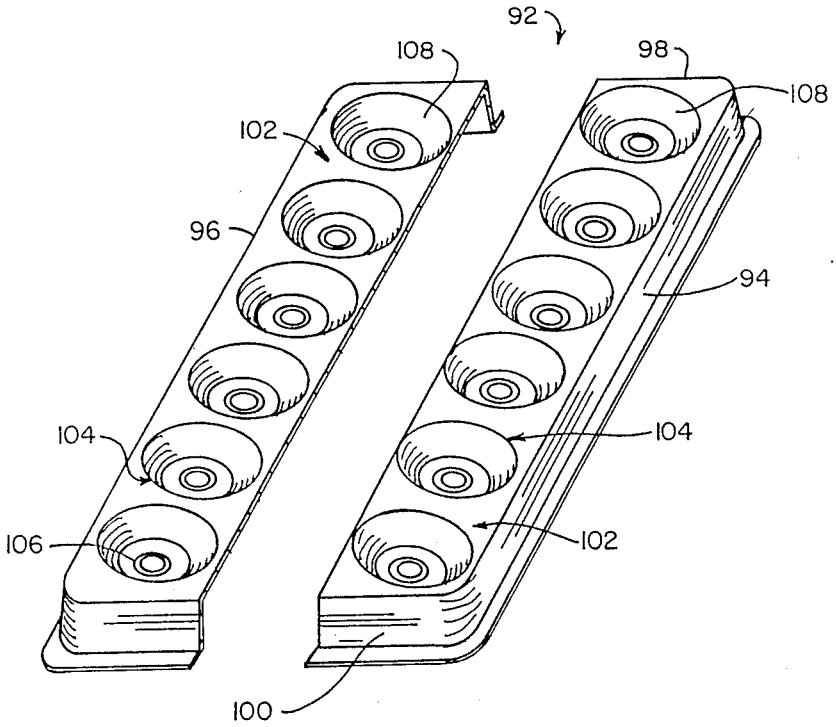
FIGS. 9–14 are perspective views illustrating other embodiments of the other shelf members associated with the present shelving system.
Figure 10:
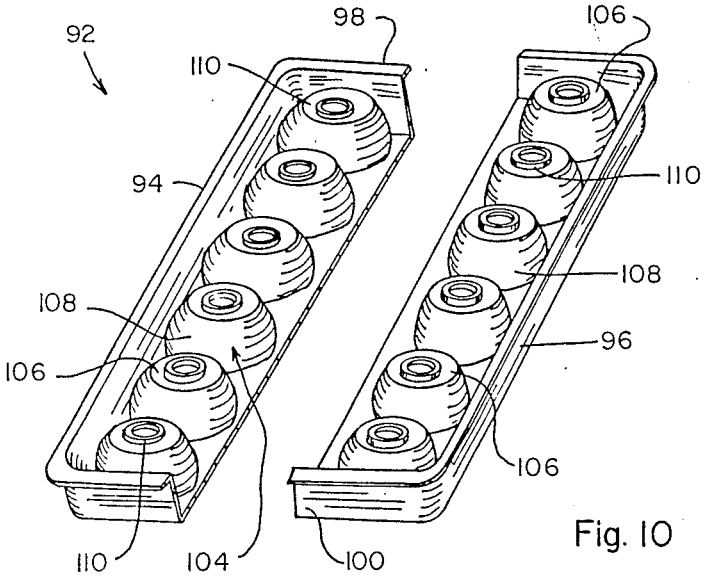

FIGS. 9 and 10 disclose another embodiment 92 of the shelf member 14 which is adaptable for use with the base shelf member 74. The shelf member 92 is similar in construction and operation to the base shelf member 74 disclosed in FIGS. 7 and 8 and includes opposed side walls 94 and 96, opposed end walls 98 and 100, a floor portion 102, and a plurality of cavities 104 similar to the cavities 86 which extend from the floor portion 102. Like the cavities 86, the cavities 104 are shown as being somewhat hemispherical in shape and each includes a bottom wall portion 106 and an annular side wall 108 as best shown in FIG. 10. The shelf member 92 differs from the shelf member 74 in that the bottom wall 106 of each cavity 104 also includes means in the form of a downwardly extending circular projection or ridge 110, which projections are similar to the projections 52 on the shelf members 14. Like the projections 52, the projections 110 are dimensioned and positioned on the respective bottom walls 106 to cooperatively engage the cap or bottle crown portion of bottled products positioned on the shelf member located immediately therebelow. Like the shelf members 14, the shelf members 92 are supported by the layer of products positioned therebelow and any number of the members 92 can be used in a stack of products. A holding or storage member similar to the member 16 shown in FIG. 6 may also be used in conjunction with a shelving system utilizing the base shelf member 74 and the shelf members 92.

Figure 11:
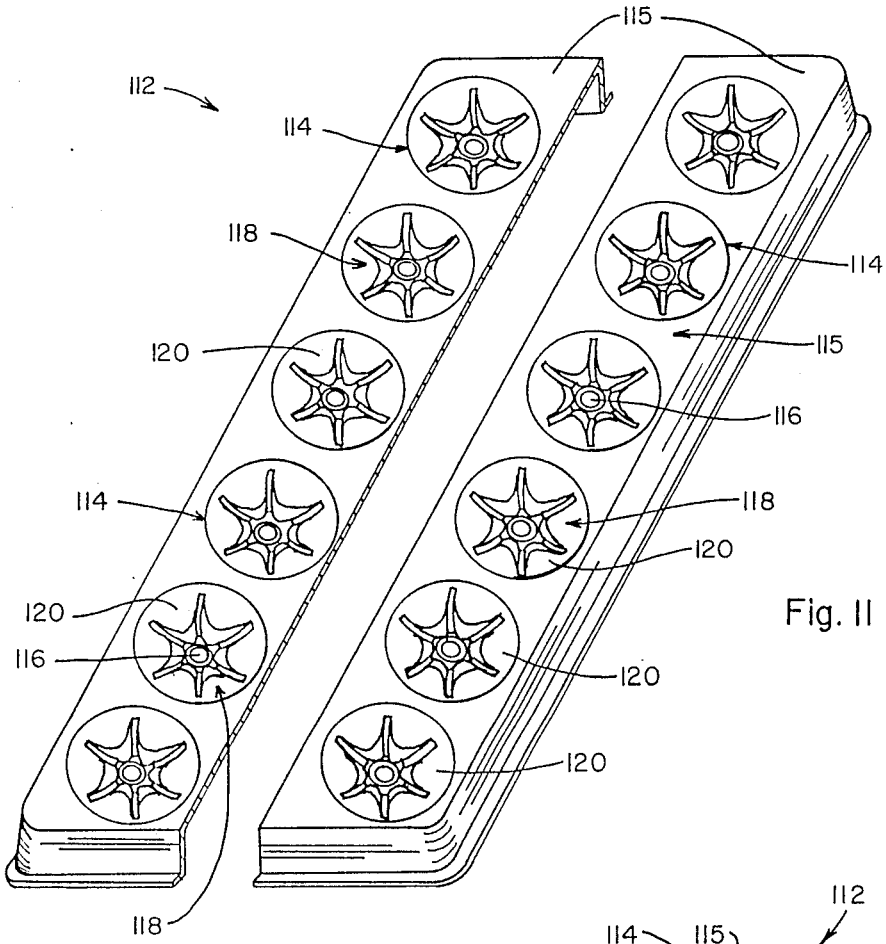
Figure 12:
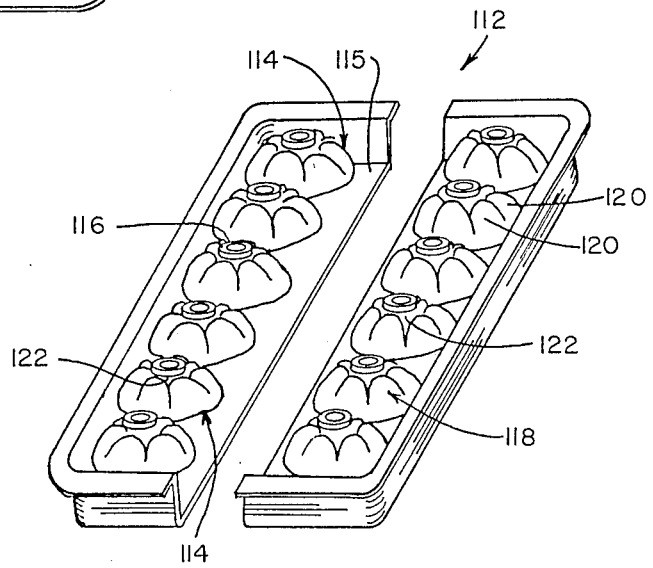

FIGS. 11 and 12 show still another modified shelving member 112 which is specifically adaptable for use in holding two liter bottled soft drink products which are packaged in known containers utilizing a petaloid bottom wall configuration. The member 112 is similar in construction and operation to the shelf member 92 including a plurality of cavities 114 which extend downwardly from the floor portion 115. Like the cavities 104, the cavities 114 are rounded in shape and each includes a relatively flat bottom wall 116 and an annular curved side wall 118 as best shown in FIG. 12. The plurality of cavities 114 differ from the cavities 104 in that the annular side walls 118 associated respectively therewith include a plurality of curved portions such as the cavity portions 120 adaptable to mate with and receive the curved bottom wall portions of a petaloid shaped bottom wall container. The cavity portions 120 are shaped and dimensioned such that when a petaloid shaped bottom container is inserted therewithin, the cavities 114 will embrace and hold said container in a stable upright position. The bottom walls 116 of each cavity 114 likewise include a downwardly extending circular projection or ridge 122 for engaging the cap or upper portion of product containers positioned therebelow. A base shelf member (not shown) similar to the base member 74 but having product holding cavities incorporated therein similar to the cavities 114 may likewise be constructed and used in conjunction with the shelf members 112.

Figure 13:
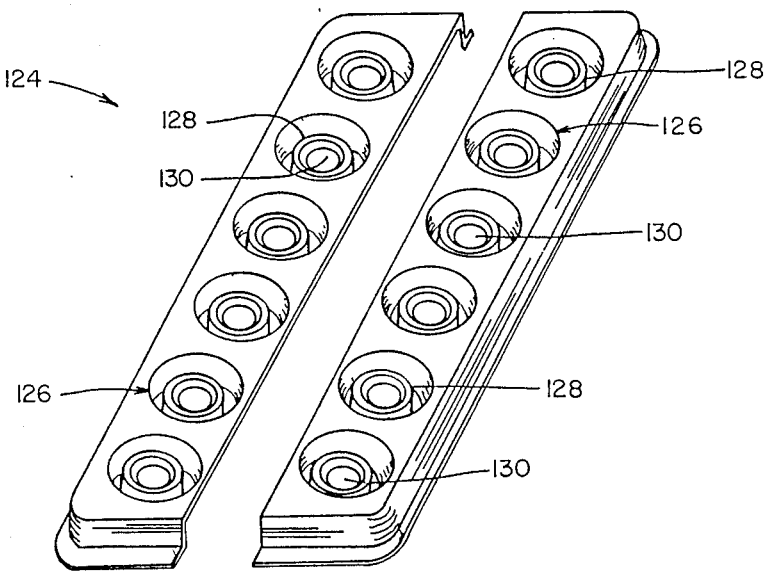
Figure 14:
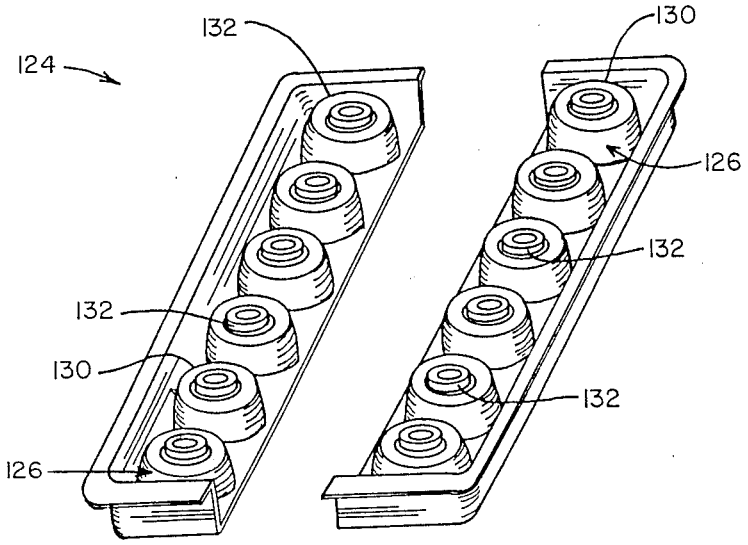

FIGS. 13 and 14 disclose another modified shelving member 124 which is specifically adaptable for use in merchandising two liter bottled soft drink products packaged in known containers having base-cup bottom wall configurations. The member 124 is likewise substantially similar in construction and operation to the shelf member 92 but differs therefrom only in that the plurality of downwardly extending cavities 126 therein each includes an upwardly projecting inner ring or circular flange 128 dimensioned and shaped to engage the recessed areas associated with the base-cup bottom wall design of some containers. Engagement of the flange portions 128 with the recessed portions of base-cup shaped container bottom walls improves the stacking capability of the present shelf members and increases the overall stability of the unit. For example, the inner projecting flanges 128 serve to reinforce the bottom wall portions of the cavities 126 and prevent buckling and collapsing thereof when the shelf member is supported on the cap or crown portion of the products positioned therebelow, and it improves the frictional fit of the bottled products positioned within the respective cavities 126 and secures said products therewithin. In addition, when properly dimensioned, the wall portions 130 of the flanges 128 lie substantially flush with at least a portion of the base-cup bottom walls of the bottled products positioned therewithin. This provides a better bearing surface for the cap or crown portions of the bottled products positioned therebelow since the wall portions 130 come into direct contact with the products positioned thereabove. It is also recognized that additional reinforcing ribs or beads could be incorporated into the cavities 126 to add strength and stability to the individual members 124 and to the overall shelving unit. Like the cavities 104, each cavity 126 includes a downwardly extending circular projection 132 (FIG. 14) similar to the projections 52 and 110 for receiving and engaging the cap or bottle crown portions of bottled products positioned on the shelf member located immediately therebelow. A base shelf member (not shown) similar to the base member 74 but having product holding cavities similar to the cavities 126 may likewise be constructed and used in conjunction with the shelf members 124.

Figure 15:
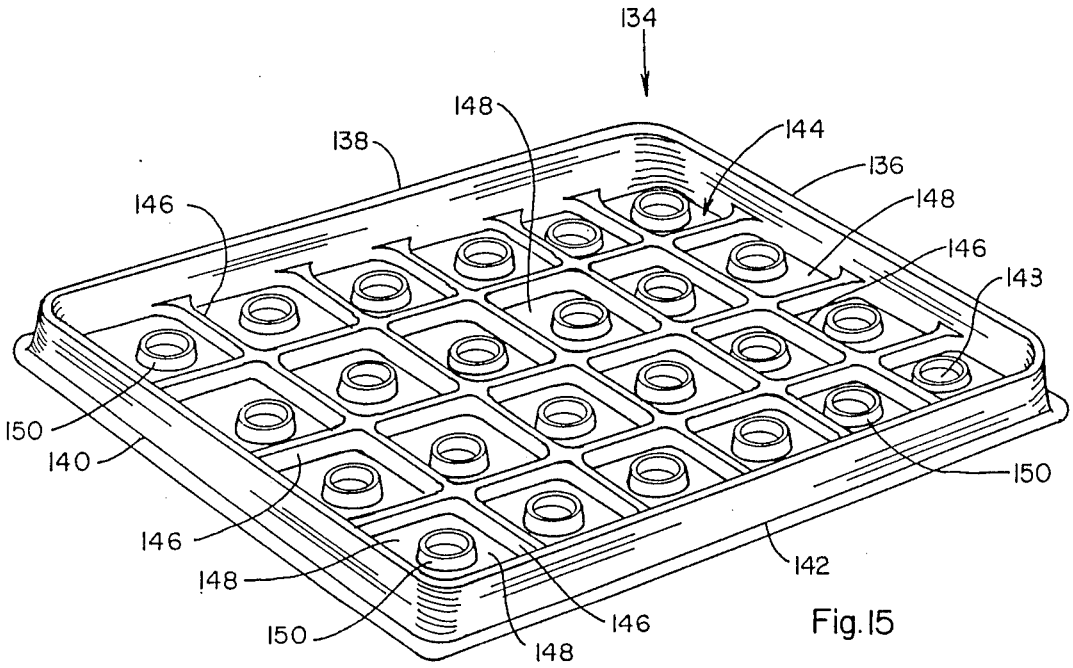
FIGS. 15 and 16 are perspective views of still another embodiment of the base shelf member of the present shelving system.
Figure 16:
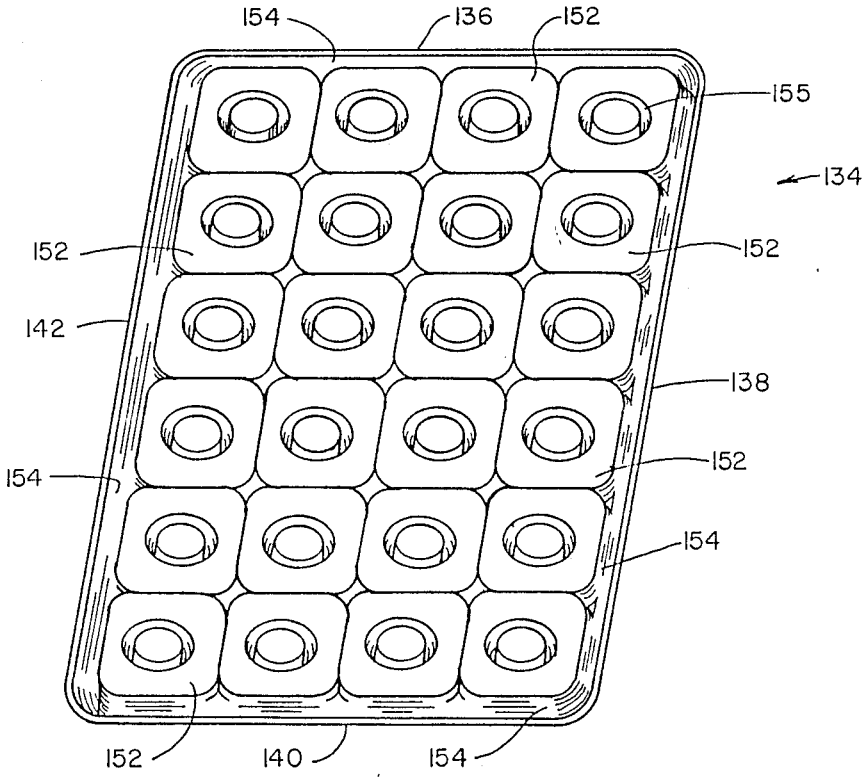
Figure 17:
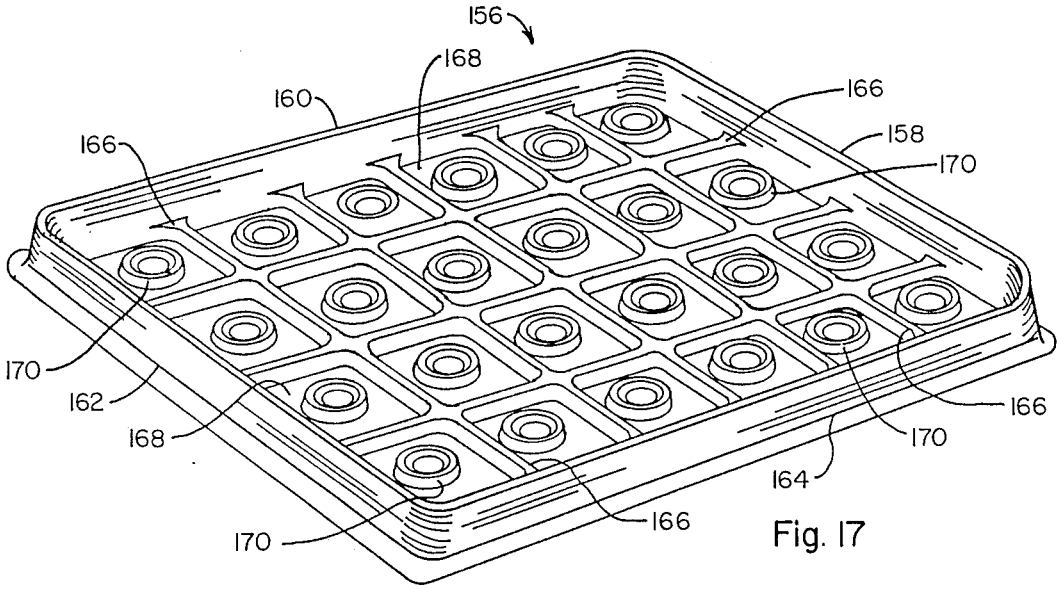
FIGS. 17 and 18 are perspective views of the other shelf members used in conjunction with the base shelf member shown in FIGS. 15 and 16.
Figure 18:
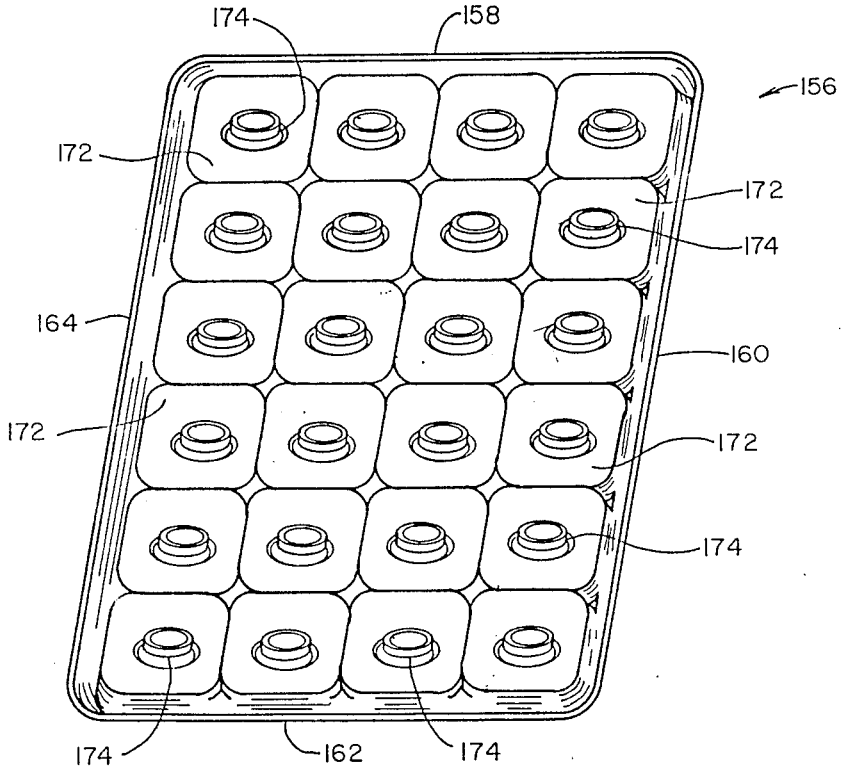

FIGS. 15–18 show the components of a further embodiment of a product merchandising display system comprising a base shelf member 134 (FIGS. 15 and 16) and one of a plurality of substantially similar shelf members 156 (FIGS. 17 and 18). More particularly, FIGS. 15 and 16 illustrate the construction of the base shelf member 134 which is somewhat similar in construction to the base shelf member 12 shown in FIGS. 2 and 3. Like the base member 12, the base member 134 is preferably of one-piece rectangular plastic molded construction and includes side walls 136, 138, 140 and 142 and a floor portion 144 which extends therebetween. The floor portion 144 includes a plurality of spaced upstanding wall portions or partitions 146 arranged in a grid-like manner thereon forming a plurality of support areas 148 for locating products positioned thereon. The partitions or dividers 146, unlike the dividers 28, are arranged and dimensioned such that each product support area 148 is adaptable for holding and retaining a bottled product such as a two liter bottled soft drink product. Each product support area 148 also includes a projecting circular flange or ridge 150 which, like the flange 128, is adaptable for engaging the recessed area associated with a container such as a container having a base-cup bottom wall configuration. The flanges 150 serve to restrict movement or shifting of the products thereon and they make for a stable stacking of such products. Bottled products positioned in engagement with the respective flanges 150 within the product support areas 148 will be engaged on all sides thereof by respective ones of the partitions 146, which partitions 146 in conjunction with the flanges 150 function to prevent movement of the products within the respective spaces 148. It is preferred that the wall dividers 146 be integrally formed with the base structure 134 for reasons previously stated. It is also recognized that the wall dividers 146 and the projecing flanges 150 will be spaced and dimensioned to accommodate any particular size and shape product container associated with the goods items to be displayed therein and the number of the product support areas 148 formed within the base shelf member 134 and the members 156 may likewise be varied without departing from the teachings of the present invention.

Figure 7:
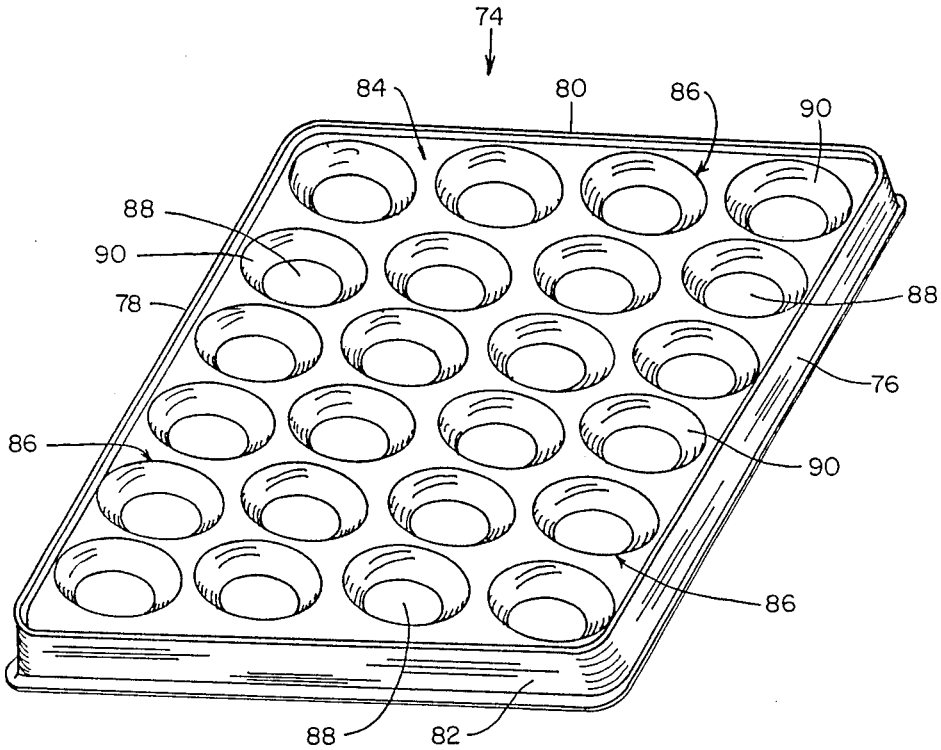
FIGS. 7 and 8 are perspective views illustrating another embodiment of the base shelf member of the present shelving system.

The specific dimensions associated with two liter bottled soft drink products utilizing a base-cup bottom wall design often times vary considerably within normal manufacturing tolerances due to the fact that such containers are made by a wide variety of manufacturers utilizing different manufacturing techniques. This can present a problem if a variety of such containers are to be positioned and received within specifically dimensioned cavities for holding such containers such as the cavities 86 and 104 (FIGS. 7 and 9). A variation in the dimensions of container bottom walls may also affect the friction fit of the containers within the cavities and the ability of such cavities to effectively hold the products in an upright and stable condition. Since the product support areas 148 are substantially rectangular in shape, they are more readily adaptable for accommodating bottled products where the dimensions of the bottom portions thereof may vary somewhat The projecting flanges 150 will help in this regard and will provide stability.

FIG. 16 illustrates the bottom configuration of the base shelf member 134. Like the base member 12, the bottom surfaces 152 of each product support area 148 are substantially coplanar and are in alignment with the free bottom edges of the side walls 136–142 such that when the base member 134 is positioned on a supporting structure such as on a store floor, the bottom surfaces 152 are flush with tne floor. In addition, a groove or channel 154, similar to the groove 34, extends circumferentially around all four sides of the bottom surface of the member 134 as shown in FIG. 16. The groove or channel 154 is formed between the side walls 136–142 and the respective side edges of the bottom surfaces 152 which lie adjacent thereto. The groove or channel 152 is similarly shaped and dimensioned to receive the cooperatively engageable flange associated with the holding or storage member such as the flange 72 associated with the storage member 16.

FIGS. 17 and 18 disclose the construction of the shelf member 156 which is specifically adaptable for use in conjunction with the base shelf member 134. The shelf member 156 is substantially similar in constuction and operation to the base shelf member 134 and includes opposed side walls 158, 160, 162, and 164, a plurality of spaced upstanding wall dividers 166 defining a plurality of adjacent product support areas 168, and a projecting flange 170 located within each product support area 168 similar to the projecting flange 150 associated with the base shelf member 134. The bottom surface configuration of the shelf member 156 is similar to the bottom surface configuration of the base shelf member 134 but differs therefrom in that the respective bottom surfaces 172 associated with the product support areas 168 each include means in the form of a downwardly extending circular projection 174, similar to the projections 52, 110, 122 and 132, which projections are dimensioned and positioned on each respective surface 172 to receive and engage the cap or bottle crown portions of bottled products positioned on the shelf member located immediately therebelow. The projections 174 perform the same functions as the projections 52, 110, 122 and 132 and enable tne shelf members 156 and the products positioned thereon to be stackably arranged as hereinbefore explained. A holding or storage member similar to the member 16 (FIG. 6) may likewise be utilized in conjunction with shelving systems utilizing the base shelf member 134.

Although it is recognized that various acceptable materials of construction are available and could be employed to construct the various shelving and storage members disclosed herein, it is usually preferred that such members be constructed from a relatively rigid plastic material able to withstand moderate impact and mishandling without breakage. Through the use of a suitable mold, each of the various members of the present shelving system can be inexpensively vacuum formed into a unitary construction from single sheets of plastic material. The shape and contour of the various shelving and storage members provide them with substantial structural integrity. It should be noted that many of the indentations shown in the drawings such as the indentations 58, 59 and 155 are formed as a direct result of the vacuum forming process used in making the various members and are not essential to the structure and operation of the various embodiments disclosed herein. It is also recognized that certain metals, metal alloys, fiberglass or even wood or other materials could be utilized in the practice of this invention but the use of plastics is preferred. The selection of the material should take into account the type of products and their containers to be merchandised therefrom and the environment where the particular shelving system is to be located. Additionally, the overall length and width of each of the members associated with the various embodiments of the present system can be varied to accommodate different display applications and different product sizes and shapes. Furthermore, signage and other indicia may be applied to the exposed wall portions of the various shelving members for attractively advertising the particular goods items being sold therefrom and to aid the merchant when restocking the shelving members. The present shelving members, as previously stated, are also stackable and nestable one in the other for ease of storage, packaging and transportation.

Figure 19:
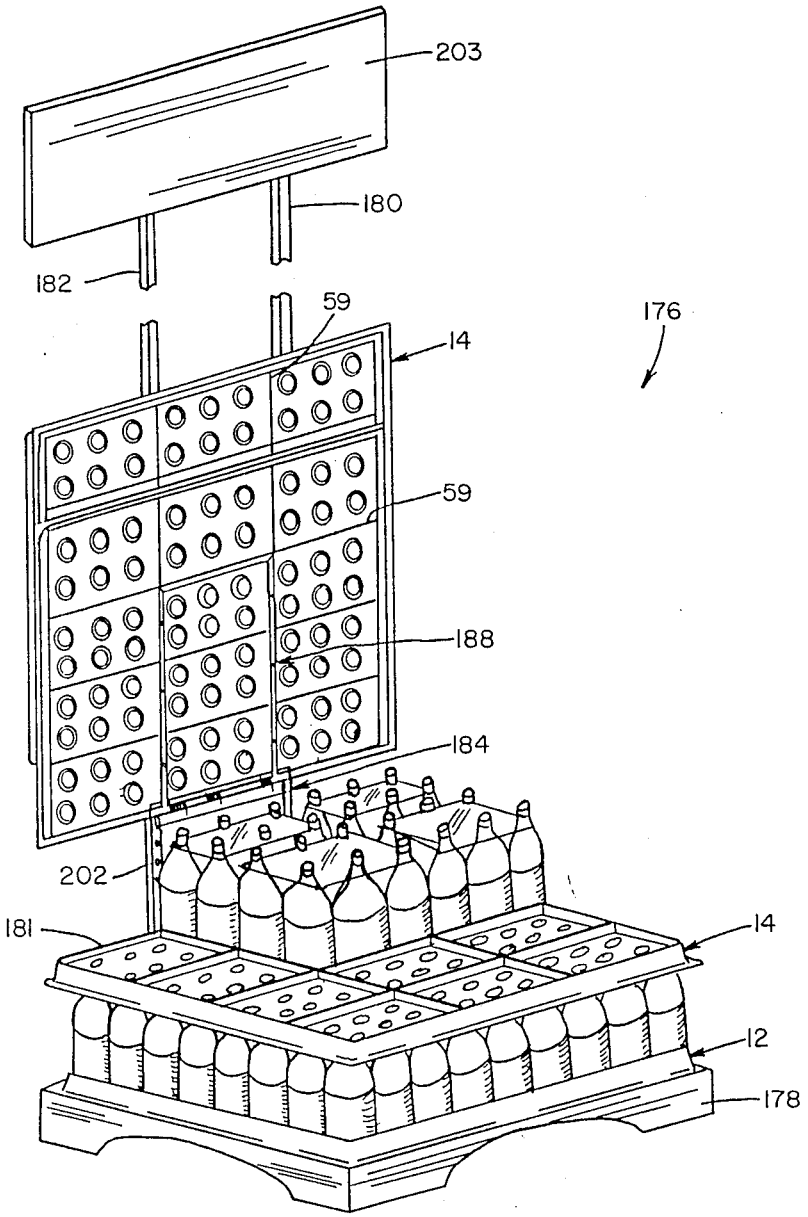
FIG. 19 is a perspective view of a shelving system having means for automatically moving the shelf members to an out-of-the-way storage position when all of the products positioned thereon are removed.
Figure 20:
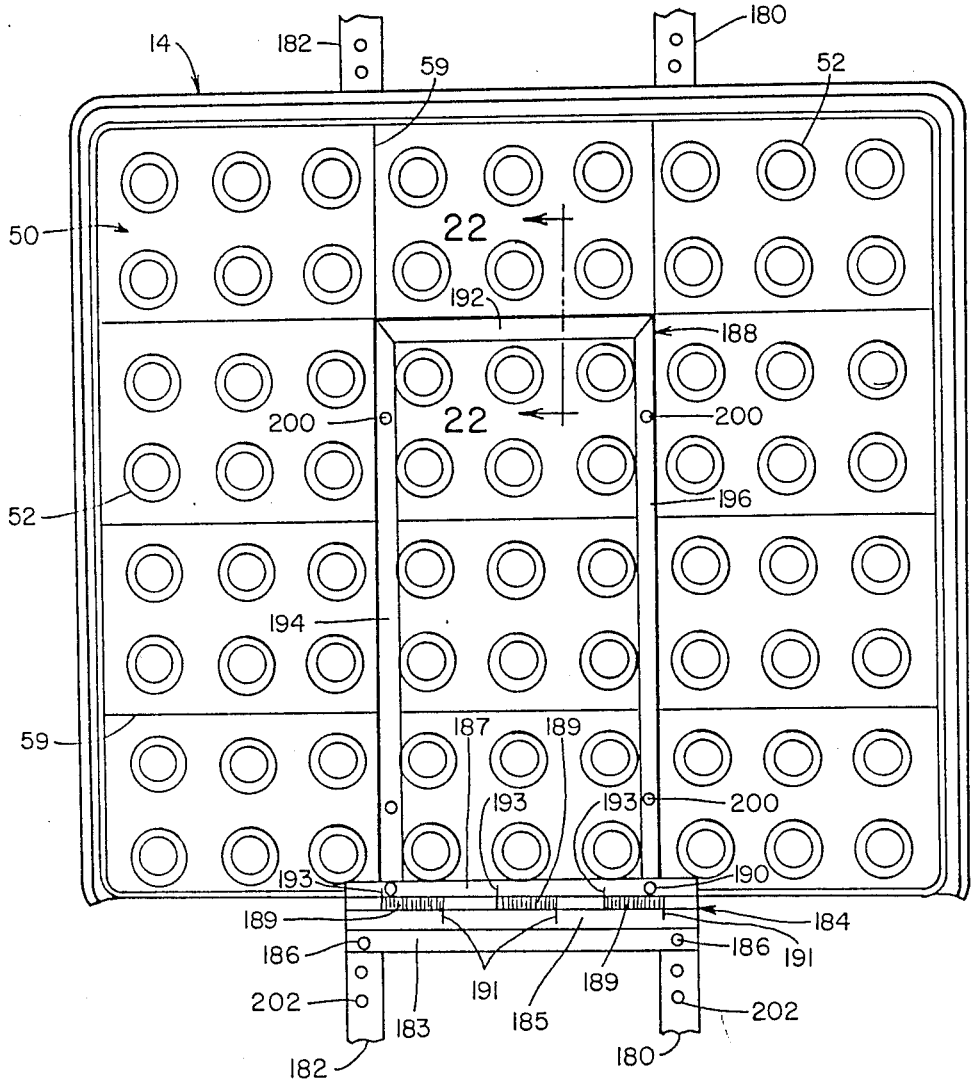
FIG. 20 is a bottom view of one of the shelf members shown in FIG. 19.

The various embodiments of the present shelving system can be utilized in a multitude of various display stand applications. FIGS. 19–22 illustrate one particular display unit arrangement 176 utilizing the present shelf members wherein the display unit 176 includes means associated therewith to enable moving the shelf members to retracted out-of-the-way storage positions as products positioned thereon are removed. The display unit 176 includes a base member 178 and a pair of upstanding frame members 180 and 182 attached adjacent the rear edge thereof. The frame members 180 and 182 may be directly attached to the base member 178 or they may be otherwise secured in a parallel upright position adjacent to the rear edge of the base member 178. A plurality of hinge assemblies 184 having spring means 189 (FIGS. 20 and 21) associated therewith are attached to the uprights 180 and 182 at intermediate spaced locations therealong and each extends the full distance therebetween as best shown in FIGS. 19 and 20. One portion 185 of each hinge assembly 184 is attached adjacent its opposite ends to the frame members 180 and 182 by any suitable means such as by the fasteners 186 (FIG. 20) and the other portion 187 thereof is similarly attached adjacent its opposite ends to a U-shaped frame assembly 188 such as by fasteners 190. The frame assembly 188 includes a cross member 192 and a pair of side frame members 194 and 196 extending substantially perpendicular thereto as shown in FIGS. 19 and 20, and each frame assembly 188 is pivotally movable between a substantially horizontal product holding position and an elevated storage position angularly related thereto. Each member 192, 194 and 196 is substantially L-shaped in cross section (FIG. 22) and includes a flange portion 198 adaptable for being inserted into the grooves or channels 59 formed in the bottom portion of the shelf member 14 as shown in FIGS. 19, 20 and 22. The frame assemblies 188 are specifically shaped and dimensioned to mate with the undersides of the particular shelf members to which they are attached and, for illustrative purposes, the frame assembly 188 is shown fixedly attached to the shelf member 14. It is also anticipated that the frame members 192–196 could be L-shaped, T-shaped, or otherwise configured so long as they have flange portions 198 positioned and dimensioned to mate with the corresponding grooves 59 as aforesaid. If the shelf members to be utilized in the display stand arrangement 176 are made by a manufacturing process other than a vacuum forming process, a groove similar to the groove 59 should be provided to accommodate the flanges 198. Once the flanges 198 are inserted within the respective grooves 59, the frame assemblies 188 are secured to the respective shelf members 14 such as by securing the frame members 194 and 196 to the shelf members 14 by any suitable means such as by fasteners 200. A relatively thin elongated support member 201 may also be positioned across the upper surface of the affected product support areas 48 where the members 194 and 196 are secured to the shelf members 14 as shown in FIG. 20 to reinforce the connection therebetween.

The hinge means 184 are preferably spring biased to hold the respective shelf members 14 in their retracted upright positions as shown in FIG. 19 and each hinge 184 includes at least one spring member 189 located on the hinge pin. Each spring member 189 includes a spring portion 191 which engages the hinge portion 185 and a spring portion 193 which engages the other hinge portion 187 as shown in FIG. 20. The spring portions 191 and 193 urge the shelf members 14 toward their retracted or inoperative positions when they are empty and when full the weight of the product containers thereon holds them in their horizontal orientation. The respective hinge means 184 are also positioned vertically on the frame members 180 and 182 such that when the shelf members 14 are in their horizontal product holding positions, the projections 52 on one shelf member engage the cap or bottle crowns of the bottled products positioned on the shelf member located therebelow. To this end, a plurality of aperatures 202 are uniformly spaced along a substantial portion of each of the frame members 180 and 182 adaptable for receiving the fasteners 186. This means that the position of each hinge 184 is adjustable to accommodate bottled products of varying heights.

Once the plurality of shelf members are secured to the respective pivotally movable frame assemblies 188, the display unit 176 is ready for use. In the application illustrated in FIG. 19, a user will first load the base member 12 with a particular product and then lower the lowest shelf member to its horizontal position and load it. This process is repeated until any desired number of shelf members are loaded. The weight of the products holds the shelf members in their horizontal display positions. Since the shelf members 14 are spring biased toward their out-of-the-way retracted positions by the hinge means 184, when the last product is removed from a particular shelf member 14, that member will automatically be urged to its upright retracted position thereby exposing the products positioned on the shelf member located immediately therebelow for easy access by the customer.

Figure 21:
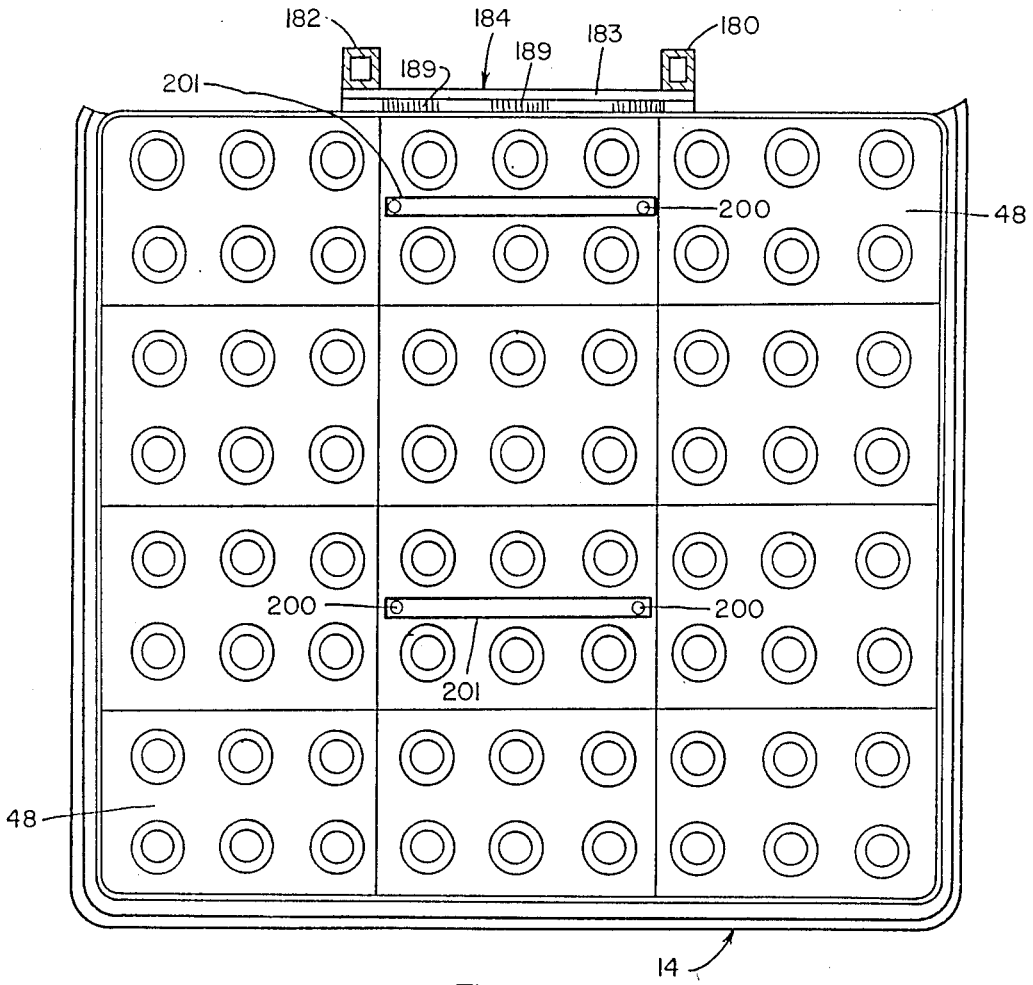
FIG. 21 is a top plan view of the shelf member shown in FIG. 20.
Figure 22:
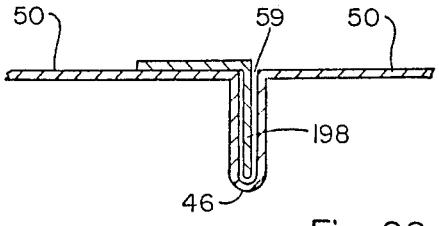
FIG. 22 is an enlarged fragmentary cross-sectional view taken along line 22–22 of FIG. 20.

The side wall of each respective shelf member 14 that is located adjacent to the frame members 180 and 182 is cut away or removed therefrom as shown in FIGS. 19–21 to allow the hinge means 184 and the frame assembly 188 to lie flush with the bottom surface of the respective shelf members 14. Each hinge means 184 is also mounted in spaced apart relationship to the frame members 180 and 182 such that when each shelf member 14 is moved to its retracted stored position, the rear peripheral edge thereof such as the edge 181 will not engage or otherwise contact the members 180 and 182. This can be accomplished by placing a spacing member (not shown) between each respective hinge 184 and the members 180 and 182 or by attaching or otherwise incorporating into each hinge assembly 184 an L-shaped flange portion such as the flange portion 183 (FIG. 20). These features enable the shelf members 14 to be stackable and nestable in a staggered arrangement (FIG. 19) one on top of the other when said members are in their fully retracted vertical positions. This makes for a visually attractive display arrangement and more effectively utilizes available merchandising space. A sign board 203 (FIG. 19) may optionally be attached to the upper end portions of the frame members 180 and 182 for advertising purposes and to hide the upper ends of the members 180 and 182. Although the display stand arrangement 176 is illustrated using the base and shelf members 12 and 14, it is recognized that the various other base and shelf members disclosed herein can also be used although some modifications may be necessary.

Although the use of spring biased hinge means such as the hinge assemblies 184 is generally preferred, it is also recognized that non-biased pivot means may likewise be utilized. In this situation, when the last product is removed from a particular shelf member 14, that member will have to be manually raised to its upright retracted position and held in such retracted position by cooperatively engageable fastener means located respectively on one or both of the flange members 180 and 182 and the shelf members 14. Such cooperatively engageable fastener means may include hook and eyelet devices, magnets, synthetic materials which adhere when pressed together such as Velcro type fastener strips and so forth. Since the shelf members 14 are nestable one on top of the other in a staggered arrangement (FIG. 19), when they are in their fully retracted vertical positions, the cooperatively engageable fastener means must be respectively positioned on the frame membes 180 and 182 and on each shelf member 14 such that each of said fastener means may be easily fastened together without interference from the retracted shelf members located thereabove. It is also anticipated that the base member 178 may include rolling means (not shown) such as casters or rollers for easily rolling the entire display arrangement 176 across a supporting surface from one location to another.

Thus there has been shown and described several embodiments of a novel stackable shelving system for use in storing and merchandising shelved products, which devices and systems fulfill all of the objects and advantages sought thereof. Many changes, modifications, variations, and other uses and applications of the present devices and systems will, however, become apparent to those skilled in the art after considering this specification and the accompanying drawings. All such changes, modifications, variations, and other uses and applications which do not depart from the spirit and scope of the invention are deemed to be covered by the invention which is limited only by the claims which follow.

What is claimed is:

1. A product display shelving unit adaptable for holding product containers in a stackable arrangment thereon comprising a base member having a load carrying portion associated therewith, a pair of rod-like members attached at one end to the base member and extending upwardly therefrom in spaced parallel relationship, a base shelf member adaptable in one position thereof to be supported on said base member, said base shelf member including a product supporting floor portion and a peripheral side wall extending therearound, said floor portion having a surface contour defining a plurality of adjacent product support areas thereover, a plurality of similar other shelf members each having a floor portion contoured to define a similar plurality of product support areas each including means to engage the upper end of a product container positioned in a product layer located therebelow, said plurality of similar other shelf members each having spaced opposed front and rear edges and spaced opposed side edges, a frame assembly attached to each of said plurality of other shelf members at a location intermediate the opposed side edges thereof, means hingedly attaching the respective frame assemblies to the rod-like members at spaced locations therealong, said frame assemblies and the attached shelf members being movable between a load supporting position parallel to the base shelf member and a non-load supporting raised position adjacent to the rod-like members, each of said frame assemblies and said associated means being attached to the rod-like members such that when each of the respective other shelf members is moved to its load supporting position its floor portion will be in position to engage the product containers in the product layer located immediately therebelow, said other shelf members being held in their load supporting positions by the weight of the product containers positioned thereon, said frame assemblies comprise elongated flanged structural members, at least one of said elongated flanged structural member of each of said frame assemblies being attached to said rod-like members at said means for hingedly attaching, and wherein the floor portions of said other shelf members each include channels which receive flanged portions of a respective flanged structural member.

2. The product display shelving unit of claim 1 including means for automatically moving each of said other shelf members to its raised position when all of the product containers positioned thereon are removed therefrom.

3. The product display shelving unit of claim 1 including means to adjust the positions where the frame assemblies and associated hinge means are attached to the rod-like members to accommodate product containers of varying heights.

4. Tne product display shelving unit of claim 3 wherein said means to adjust the shelf positions on the rod-like members includes a plurality of aperatures spaced along at least a portion of each of said elongated members.

5. The product display shelving unit of claim 1 wherein each of said product support areas includes a cavity adaptable for receiving and holding a product container positioned therewithin.

6. The product display shelving unit of claim 2 wherein said means for automatically moving each of said other shelf members to its raised position includes biasing means.

7. The product display unit of claim 1 wherein said base member includes means for rolling the shelving unit across a supporting surface.

8. The product display unit of claim 1 wherein the plurality of product support areas associated with said base shelf member and said plurality of other shelf members each include means to engage the lower end of a product container positioned thereon.

* * * * *

UNITED STATES PATENT OFFICE

CERTIFICATE OF CORRECTION

Patent No. 4,750,623 Dated June 14, 1988

Inventor(s) Paul Flum

It is certified that error appears in the above-identified patent and that said Letters Patent are hereby corrected as shown below:

Col. 5, line 19, "tne" should be --the--.

Col. 6, line 28, "tne" should be --the--.

Col. 6, line 29, after "floor", insert --or--.

Col. 6, line 45, "tne" should be --the--.

Col. 7, line 2, "whicn" should be --which--.

Col. 8, line 58, "tne" should be --the--.

Col. 13, line 11, after "somewhat", insert --.-- .

Col. 13, line 21, "tne" should be --the--.

Col. 13, line 55, "tne" should be --the--.

Col. 16, line 68, "arrangment" should be --arrangement--.

UNITED STATES PATENT AND TRADEMARK OFFICE

CERTIFICATE OF CORRECTION

PATENT NO. : 4,750,623

DATED : June 14, 1988

INVENTOR(S) : Paul Flum

It is certified that error appears in the above-identified patent and that said Letters Patent is hereby corrected as shown below:

Col. 18, line 15, "Tne" should be --The--.

Signed and Sealed this

Twenty-fifth Day of October, 1988

*Attest:*

DONALD J. QUIGG

*Attesting Officer*

*Commissioner of Patents and Trademarks*